US006214419B1

(12) United States Patent
Dinh et al.

(10) Patent No.: US 6,214,419 B1
(45) Date of Patent: Apr. 10, 2001

(54) IMMERSION COATING PROCESS

(75) Inventors: Kenny-tuan T. Dinh, Webster; Richard H. Nealey, Penfield; John G. Matta, Pittsford, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/466,565

(22) Filed: Dec. 17, 1999

(51) Int. Cl.[7] ..... B05D 1/18
(52) U.S. Cl. ..... 427/430.1
(58) Field of Search ..... 427/430.1

(56) References Cited

U.S. PATENT DOCUMENTS

| | | | | |
|---|---|---|---|---|
| 4,265,990 | * | 5/1981 | Stolka et al. | 430/59 |
| 4,390,611 | * | 6/1983 | Ishikawa et al. | 430/59 |
| 4,551,404 | * | 11/1985 | Hiro et al. | 430/59 |
| 4,588,667 | * | 5/1986 | Jones et al. | 430/73 |
| 4,596,754 | * | 6/1986 | Tsutsui et al. | 430/58 |
| 4,610,492 | * | 9/1986 | Yashiki et al. | 430/58 |
| 4,618,559 | * | 10/1986 | Yashiki | 430/127 |
| 4,797,337 | * | 1/1989 | Law et al. | 430/58 |
| 4,988,597 | * | 1/1991 | Spiewak et al. | 430/62 |
| 5,244,762 | * | 9/1993 | Spiewak et al. | 430/64 |
| 5,320,364 | * | 6/1994 | Mistrater et al. | 279/2.17 |
| 5,520,399 | * | 5/1996 | Swain et al. | 279/2.15 |
| 5,616,365 | * | 4/1997 | Nealey | 427/430.1 |
| 5,693,372 | * | 12/1997 | Mistrater et al. | 427/430.1 |
| 5,725,667 | | 3/1998 | Petropoulos et al. | 118/407 |
| 5,820,897 | | 10/1998 | Chambers et al. | 425/522 |

* cited by examiner

*Primary Examiner*—Shrive Beck
*Assistant Examiner*—Michael Barr
(74) *Attorney, Agent, or Firm*—John L. Haack; Peter H. Kondo

(57) ABSTRACT

A process for immersion coating of a substrate including positioning a substrate having a top and bottom within a coating vessel having an inner surface to define a space between the inner surface and the substrate, filling at least a portion of the space with a coating mixture; stopping the filling slightly below the top of the substrate, initiating removal of the coating mixture at a gradually increasing rate to a predetermined maximum flow rate in a short predetermined distance, and continuing removal of the coating mixture at substantially the predetermined maximum flow rate to deposit a layer of the coating mixture on the substrate.

12 Claims, 1 Drawing Sheet

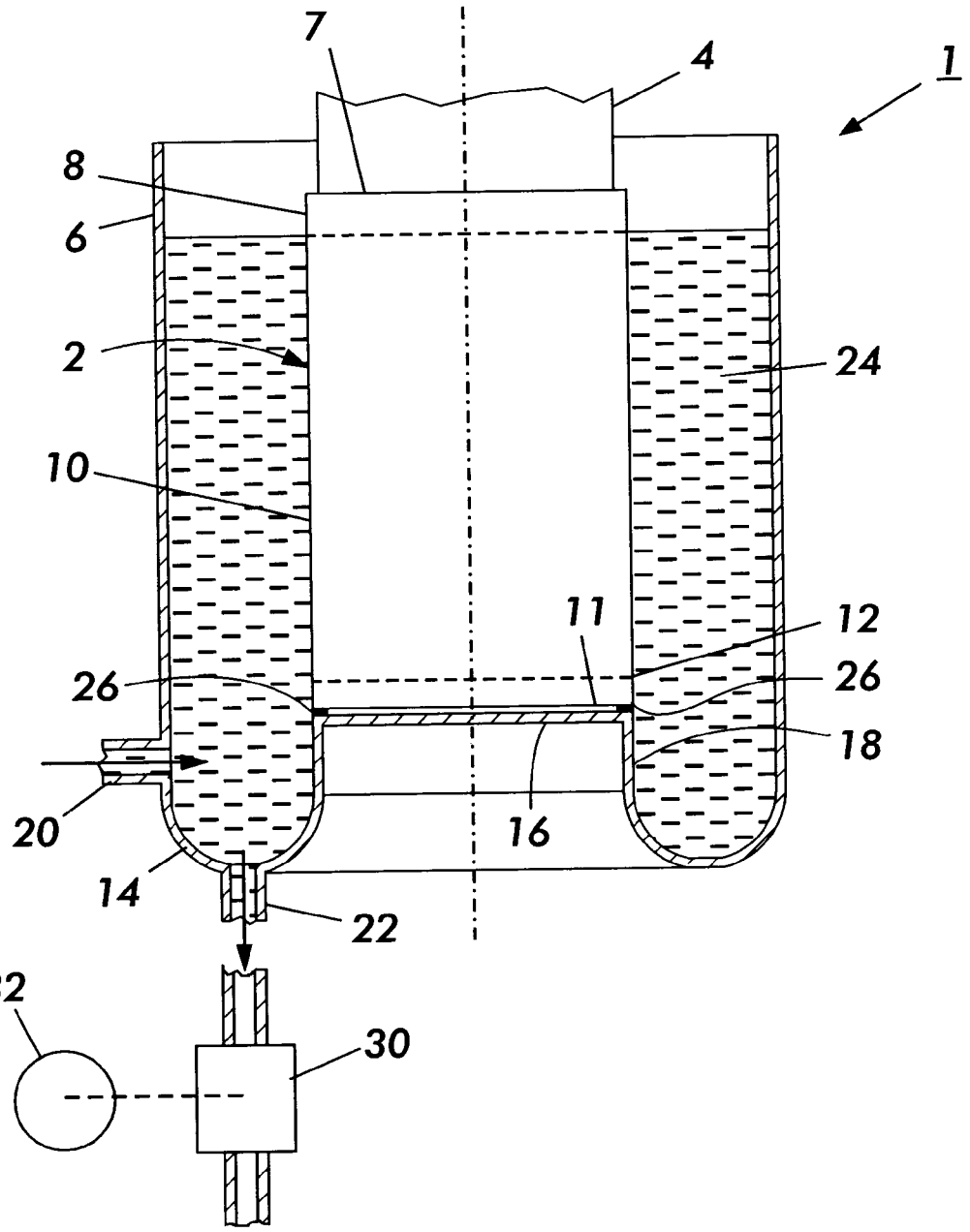
7
4
1
8
6
2
24
10
11
12
26
26
18
20
16
14
22
32
30

IMMERSION COATING PROCESS

BACKGROUND OF THE INVENTION

This invention relates in general to coating of electrostatographic imaging members and, more specifically, to a process for immersion coating of electrostatographic imaging drums.

Electrostatographic imaging members are well known. Typical electrophotographic imaging members include photosensitive members (photoreceptors) that are commonly utilized in electrophotographic (xerographic) processes in either a flexible belt or a rigid drum configuration. These electrophotographic imaging members comprise a photoconductive layer comprising a single layer or composite layers. One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer, the photoconductive layer is sandwiched between a contiguous charge transport layer and the supporting conductive layer. Alternatively, the charge transport layer may be sandwiched between the supporting electrode and a photoconductive layer. Photosensitive members having at least two electrically operative layers, as disclosed above, provide excellent electrostatic latent images when charged with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a member such as paper.

Electrostatographic imaging drums may be coated by many different techniques such as spraying coating or immersion (dip) coating. Dip coating is a coating method typically involving dipping a substrate in a coating solution and taking up the substrate. In dip coating, the coating thickness depends on the concentration of the coating material and the take-up speed, i.e., the speed of the substrate being lifted from the surface of the coating solution. It is known that the coating thickness generally increases with the coating material concentration and with the take-up speed.

Another technique for immersion coating comprises (a) positioning the substrate within a coating vessel to define a space between the vessel and the substrate and providing a downwardly inclined surface contiguous to the outer surface at the end region of the substrate; (b) filling at least a portion of the space with a coating solution; and (c) withdrawing the coating solution from the space, thereby depositing a layer of the coating solution on the substrate. This process is described in U.S. Pat. No. 5,616,365, the entire disclosure thereof being incorporated herein by reference. When this process is utilized for coating a large drum in which coating fluid is withdrawn at the bottom to deposit a coating layer on the drum located in the center of a coating vessel, it has produced uniform and defect free coating for thin undercoating layers and thick charge transport layers. However, attempts to form a coating of a charge generating dispersion on a previously formed undercoating layer, non-uniform coatings are encountered characterized by fingering patterns and wavy flow patterns throughout the drum surface. These defects are unacceptable for high printing quality requirements such as extremely uniform thickness and defect free charge generating layer coatings. Solutions to these coating problems are crucial for complex, advanced high tolerance imaging systems.

INFORMATION DISCLOSURE STATEMENT

U.S. Pat. No. 5,616,365 to Nealey, issued Apr. 1, 1997— A method is disclosed for coating a substrate having an end region including: (a) positioning the substrate within a coating vessel to define a space between the vessel and the substrate and providing a downwardly inclined surface contiguous to the outer surface at the end region of the substrate; (b) filling at least a portion of the space with a coating solution; and (c) withdrawing the coating solution from the space, thereby depositing a layer of the coating solution on the substrate.

U.S. Pat. No. 5,693,372 to Mistrater et al, issued Dec. 2, 1997— A process for dip coating drums comprising providing a drum having an outer surface to be coated, an upper end and a lower end, providing at least one coating vessel having a bottom, an open top and a cylindrically shaped vertical interior wall having a diameter greater than the diameter of the drum, flowing liquid coating material from the bottom of the vessel to the top of the vessel, immersing the drum in the flowing liquid coating material while maintaining the axis of the drum in a vertical orientation, maintaining the outer surface of the drum in a concentric relationship with the vertical interior wall of the cylindrical coating vessel while the drum is immersed in the coating material, the outer surface of the drum being radially spaced from the vertical interior wall of the cylindrical coating vessel, maintaining laminar flow motion of the coating material as it passes between the outer surface of the drum and the vertical interior wall of the vessel, maintaining the radial spacing between the outer surface of the drum and the inner surface of the vessel between about 2 millimeters and about 9 millimeters, and withdrawing the drum from the coating vessel.

U.S. Pat. No. 5,725,667 to Petropoulos et al, issued Mar. 10, 1998— There is disclosed a dip coating apparatus including: (a) a single coating vessel capable of containing a batch of substrates vertically positioned in the vessel, wherein there is absent vessel walls defining a separate compartment for each of the substrates; (b) a coating solution disposed in the vessel, wherein the solution is comprised of materials employed in a photosensitive member and including a solvent that gives off a solvent vapor; and (c) a solvent vapor uniformity control apparatus which minimizes any difference in solvent vapor concentration encountered by the batch of the substrates in the air adjacent the solution surface, thereby improving coating uniformity of the substrates.

U.S. Pat. No. 5,820,897 to Chambers et al, issued Oct. 13, 1998— This invention discloses a method of holding and transporting a hollow flexible belt throughout a coating process. The method includes placing an expandable insert into the hollow portion of a seamless flexible belt, and expanding the insert until it forms a chucking device with a protrusion on at least one end. A mechanical handling device is then attached to the protrusion, and will be used to move the chuck and the belt through the dipping process, as materials needed to produce a photosensitive device are deposited onto the surface of the belt, allowing it to be transformed into an organic photoreceptor. The chucking device and flexible belt are then removed from the mechanical handling device, the belt is cut to the desired width, and the chuck is removed from the inside of the photoreceptor.

CROSS REFERENCE TO COPENDING APPLICATIONS

U.S. patent application Ser. No., to Dinh et al., entitled "IMMERSION COATING SYSTEM", filed concurrently herewith (Attorney Docket Number D/99679Q)—A coating process is disclosed including providing an assembly comprising a hollow cylinder having an upper end and a lower end sandwiched between and in pressure contact with a first spacing device and a second spacing device, a hollow shaft coaxial with the cylinder connecting the first spacing device and the second spacing device, mounting the assembly on a vertical rod which is concentric to and mounted within a cylindrical coating vessel having a top and bottom, introducing coating liquid into the coating vessel adjacent to the bottom to immerse most of the cylinder, and withdrawing the liquid from the coating vessel adjacent to the bottom to deposit a layer of the coating liquid on the cylinder. Apparatus for carrying out this coating process is also disclosed.

BRIEF SUMMARY OF THE INVENTION

It is, therefore, an object of the present invention to provide an improved immersion coating process that overcomes the above noted deficiencies.

It is another object of the present invention to provide an improved immersion coating process that forms coatings free of fingering patterns.

It is still another object of the present invention to provide an improved immersion coating process that forms coatings free of wavy flow patterns It is yet another object of the present invention to provide an improved immersion coating process that does not require the use of expensive precision mechanical devices for the raising of drums from a coating solution or the lowering of a coating bath from the inserted drums.

It is another object of the present invention to provide an improved layered electrostatographic imaging member wherein the interior surface of the substrate is not coated by coating solutions used in the process.

The foregoing objects and others are accomplished in accordance with this invention by providing a process for immersion coating of a substrate comprising positioning a substrate having a top and bottom within a coating vessel having an inner surface to define a space between the inner surface and the substrate, filling at least a portion of the space with a coating mixture; stopping the filling slightly below the top of the substrate, initiating removal of the coating mixture at a gradually increasing rate to a predetermined maximum flow rate in a short predetermined distance, and continuing removal of the coating mixture at substantially the predetermined maximum flow rate to deposit a layer of the coating mixture on the substrate.

DESCRIPTION OF THE DRAWINGS

A more complete understanding of the present invention can be obtained by reference to the accompanying drawings wherein:

The FIGURE is a schematic partial cross-section in elevation of a substrate being immersion coated in a coating vessel.

This FIGURE merely schematically illustrates the invention and is not intended to indicate relative size and dimensions of the device or components thereof.

DETAILED DESCRIPTION OF THE DRAWING

Referring to the FIGURE, an immersion coating system 1 is shown wherein a substrate 2 being moved by chuck assembly 4 into position inside the coating vessel 6. The substrate 2 may be employed in the fabrication of photosensitive members wherein each substrate preferably has a hollow, endless configuration and defines a top 7, a top region 8 (a non-imaging area), a center region 10 (an imaging area), a bottom 11, and an end region 12 (a non-imaging area). The precise dimensions of these three substrate regions vary in different embodiments. As illustrative of typical dimensions, the top region 8 ranges in length from about 10 millimeters to about 50 millimeters, and preferably from about 20 millimeters to about 40 millimeters. The center region may range in length from about 200 millimeters to about 400 millimeters, and preferably from about 250 millimeters to about 300 millimeters. The end region may range in length from about 10 millimeters to about 50 millimeters, and preferably from about 20 millimeters to about 40 millimeters. For those embodiments where the substrate has a hollow, endless configuration with open ends, the bottom 11, the top 7, and the various surfaces of the substrate include an outer surface, and an inner surface within the substrate interior.

Any suitable chuck assembly can be used to hold the substrate including the chuck assemblies disclosed in U.S. Pat. No. 5,320,364, and U.S. Pat. No. 5,520,399, the entire disclosures thereof being incorporated by reference.

The coating vessel 6 defines a channel 14, wherein the channel delineates a projecting member 16. An inclined surface 18 is defined wholly or partly by the sides of the projecting member 16. A coating mixture entrance 20 and a coating mixture exit 22 are indicated. The coating mixture may be introduced by any suitable conventional device such as gravity, pump (not shown, or the like. A space 24 is defined between the outer surface of the substrate 2 and the inner surface of the vessel 6. In certain embodiments, the projecting member 16 can be a separate piece which is disposed inside the vessel. A seal member 26 may be present in any of the embodiments described herein to facilitate a fluid tight seal between the projecting member and the substrate. The outer surface of the seal member 26 may form a part of the inclined surface. The seal member is preferably made of a compressible material to insure that no coating solution penetrates to the interior of the substrate. The composition of the seal member is chosen to be compatible with the solvent used in the coating operation. Examples of suitable materials for the seal member include fluorocarbon, ethylene-propylene copolymer, nitrile (Buna N), and Kevlar™.

Substrate 2 preferably forms a fluid tight seal with the projecting member 16 via the seal member 26 to prevent entry of the coating solution into the substrate interior. The inclined surface 18, which is depicted with a vertical slope, is contiguous to the bottom end 13 of the substrate, wherein the inclined surface 18 is defined by the outer surface of the seal member 26 and by the sides of the projecting member 16. The substrate is preferably positioned vertically in the coating vessel 6. The vessel 6 preferably has a cylindrical cross section and the substrate 3 is preferably positioned so that is coaxial with vessel 6.

The outer surface of the substrate 2 may be separated from the inner surface of the vessel 6 at any suitable distance (gap) ranging for example from about 1 centimeter to about 5 centimeters. In embodiments the inner surface of the coating vessel can be spaced from the drum by a "gap" distance of about 5 millimeters to about 5 centimeters, and preferably by a distance of about 10 millimeters to about 3 centimeters. The volume of the space ranges, for example, from about 140 cubic centimeters to about 5000 cubic centimeters depending on the length and diameter of the substrate to be coated and the coating gap used. For example, the smaller volume is that calculated for a 30 millimeter drum of 253 millimeter length and a 1 centimeter coating gap. The larger volume is that for a drum of 230 millimeter radius and a length of 500 millimeter and a coating gap of 1.2 centimeter. At least a portion of the space, preferably to almost the top 7 of substrate 2, between the substrate 7 and the inner surface of the vessel 6 is filled with a coating mixture via, for example, the coating mixture entrance 20. Thus, the filling of space 24 with the coating mixture is stopped slightly below the top of the substrate. In embodiments the filling can be stopped at from about 1 millimeters and about 10 millimeters below the top of the substrate.

The coating mixture is withdrawn from the space 24 between substrate 2 and vessel 6 via any suitable exit, for example, exit 22. A pump 30 moves the coating mixture out of space 24 in a downwardly direction along the outer surface of substrate 2 and out exit 22. Pump 30 is driven by a variable speed motor 32. Any suitable pump may be used to move the coating mixture out of space 24. Typical pumps include, for example, gear pumps, centrifugal pumps, and the like. A positive displacement metering pump or a syringe type pump is preferred. The rate of removal of the coating mixture from the space 24 may be controlled by any suitable technique. Typical techniques include, for example, altering the pumping rate by means of a variable speed motor, adjustable valve, and the like. Preferably, the pumping rate is controlled by a conventional programmable motor controller to ensure more precise control of the rate of removal of the coating mixture from the space 24.

The coating mixture is initially removed (withdrawn) at a gradually increasing rate (ramped) from 0 to a predetermined maximum flow rate in a predetermined distance of, for example, about 2 millimeters and about 20 millimeters, and coating mixture removal is thereafter substantially constant at the predetermined maximum flow rate to deposit a layer of the coating mixture on the substrate 2. During ramping, the deposited coating varies in thickness from zero to a predetermined maximum film thickness. The predetermined distance can be, for example, between about 10 millimeters and about 20 centimeters, and preferably, the predetermined distance is between about 5 millimeters and about 10 millimeters. This distance is preferably in a region of the upper edge of the drum which is outside of the imaging area. Thus, the change in rate of coating material withdrawal occurs until the desired predetermined maximum coating material withdrawal rate is reached. Thereafter, the coating speed is constant. The gradually increasing rate may be at a straight line curve rate or along convex or concave line curve. However, any such convex or concave line curve should be a shallow one because any sudden change in liquid withdrawal rate can impact on the shape of the meniscus formed between the drum surface and adjacent inner vessel wall and also in the formation of the contact line between the coating mixture and drum surface. As a result, it could lead to numerous undesirable coating defects. Preferably, the gradual change in flow rate is at a constant acceleration. The ramping time should be minimized to form a small area or ring of non-uniformly deposited coatings. Typically, the ramping time ranges from about 15 seconds to about 20 seconds. The rate of increase of withdrawal can be empirically determined. The variables that affect the rate of increase of withdrawal include, for example, the specific solvent, the specific pigment, the specific film forming binder, the concentrations of these materials, the gap distance, coating mixture viscosity, surface tension, wetability of the surface of the substrate or preexisting layers, and the like. Alteration of these materials affect, but do not eliminate problems such as fingering patterns, bead rings and the like in the absence of ramping of the coating mixture withdrawal rate. Changing pigment ratio, such as from 50:50 to 40:60 does not achieve the results achieved with ramping. An increase in coating solids content and/or an increase in viscosity of the coating mixture requires an increase in the ramping speed because the predetermined constant speed required to coat is slower. In other words, with the same ramping speed, one would arrive at the coating speed sooner.

The desired predetermined maximum coating material withdrawal rate is the rate which deposits the desired coating thickness for the particular coating mixture utilized. This rate is essentially identical to the constant drum withdrawal rate that is used in conventional dip coating processes where the drum is removed from a coating bath to obtain a desired coating thickness.

The size of the gap between the substrate and the adjacent vessel wall is important, and is directly related to ramping speed. More specifically, a smaller gap leads to more instability of the meniscus and requires a slower acceleration to the desired coating speed. This prevents the meniscus of the coating mixture between the drum surface and adjacent vessel wall from becoming unstable. Furthermore, increasing of the distance from the drum surface to adjacent vessel wall will decrease the deformation of liquid coating mixture meniscus. Hence, a sudden change in withdrawal rate in a smaller coating vessel to adjacent drum surface distance can magnify the coating defect. The larger the coating vessel inner wall to adjacent drum surface distance, i.e., gap, the less concave is the meniscus. As a result, the change of meniscus can impact the coating defects in a less severe manner if the coating gap is large. Thus, for any given set of variables, there is a ramping rate coating window.

Generally, the distance of ramping is between about 10 millimeters and about 20 millimeters. This distance is applicable to any diameter substrate. In other words, the distance of ramping is independent of drum diameter. In a typical example, the acceleration takes place over a distance of about 20 millimeters. Thus, the flow rate is increased from a withdrawal rate of 0 millimeters/sec to 120 millimeters/sec, the predetermined maximum rate of coating mixture removal for the example being 120 millimeters/sec. If this ramping is not utilized for the charge generator layer coating dispersion materials and gap between the substrate and vessel wall, fingering patterns occur. Ramping of coating mixture withdrawal rate can be utilized for any suitable immersion coating system, such as for example, the coating system described in U.S. Pat. No. 5,616,365, the entire disclosure thereof being incorporated herein by reference.

The predetermined maximum rate of removal depends upon various factors such as the length and diameter of the substrate, the coating composition materials and physical characteristics, the desired coating thickness to be deposited, the spacing between the drum surface and the adjacent interior surface of the coating vessel, and the like. Withdrawal at substantially the predetermined maximum flow rate is preferably uniform to ensure that the deposited coating during the period of maximum flow rate has a substantially uniform thickness. Typical maximum rates are at a rate where the surface of the coating mixture descends at a rate ranging, for example, from about 50 millimeters/min. to about 500 millimeters/min., and preferably from about 100 millimeters/min. to about 400 millimeters/min.

This rate is the rate at which the top surface of the coating mixture travels along the surface of the drum being coated.

The substrate may be coated with a plurality of layers by repeating the steps of filling at least a portion of the space with the respective coating mixture and withdrawing the respective coating mixture from the space, thereby forming a new layer over the previous layer or layers on the substrate. The deposition of the plurality of the layers may be accomplished without moving the substrate from the vessel. It is preferred to introduce a gas such as air into the space after withdrawal of the first coating mixture from the space but prior to filling of the space with the second coating mixture to at least partially dry the layer of the first coating mixture on the substrate and any remaining first coating mixture in the coating vessel. Preferably, all of the remaining first coating mixture are dried prior to introduction of the second coating mixture in the vessel. The use of the drying gas may avoid contamination of the subsequent coating mixture from insufficiently dry or wet residues of the previous coating mixture. The drying gas may be for example air and the gas may have a temperature higher than room temperature such as a temperature ranging for instance from about 30° C. to about 70° C. The drying gas should be gently introduced at a pressure ranging for example from about 10 to about 30 psi to avoid disrupting the coated layer. The expression "coating mixture" as employed herein is defined as either a dispersion of particles dispersed in a liquid or a solution of a soluble materials such as a film forming polymer in a liquid. Although the step of initiating removal of the coating mixture at a gradually increasing rate to a predetermined maximum flow rate in a short predetermined distance, may be employed to apply any suitable coating mixture, it must be used in the process of this invention to apply dispersions such as a dispersion of charge generating particles dispersed in a solution of a film forming polymer.

The dried thickness of each coated layer on the substrate may be relatively uniform and may be, for example, from about 0.3 micrometer to about 40 micrometers in thickness. Preferably, the portion of the coated layer over the bottom end region should not be excessively thicker than the rest of the coated layer using the present invention.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Angstroms to 30 microns, although the thickness can be outside of this range. When a flexible electrophotographic imaging member is desired, the substrate thickness typically is from about 0.015 millimeter to about 0.15 millimeter. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as Mylar® (available from DuPont) or Melinex 447® (available from ICI Americas, Inc.), and the like. If desired, a conductive substrate can be coated onto an insulating material. In addition, the substrate can comprise a metallized plastic, such as titanized or aluminized Mylar®. The coated or uncoated substrate can be flexible or rigid, and can have any number of configurations such as a cylindrical drum, an endless flexible belt, and the like. The substrates preferably have a hollow, endless configuration. If the substrate is flexible, a supporting expandable chuck may be used to maintain the shape of the substrate during the immersion coating process of this invention.

Each coating mixture may comprise materials typically used for any layer of a photosensitive member including such layers as a subbing layer, a charge barrier layer, an adhesive layer, a charge transport layer, and a charge generating layer, such materials and amounts thereof being illustrated for instance in U.S. Pat. Nos. 4,265,990, 4,390,611, 4,551,404, 4,588,667, 4,596,754, and 4,797,337, the entire disclosures of these patents being incorporated by reference.

In embodiments, a coating mixture may include the materials for a charge barrier layer including, for example, polymers such as polyvinylbutyral, epoxy resins, polyesters, polysiloxanes, polyamides, polyurethanes, and the like. Materials for the charge barrier layer are disclosed in U.S. Pat. Nos. 5,244,762 and 4,988,597, the disclosures of which are totally incorporated by reference.

In other embodiments, a coating mixture may be formed by dispersing any suitable charge generating particles in a solution of a film forming polymer. Typical charge generating particles include, for example, azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlorophthalocyanine, and the like; quinacridone pigments; azulene compounds; and the like. Typical film forming polymers include, for example, polyester, polystyrene, polyvinylbutyral, polyvinyl pyrrolidone, methyl cellulose, polyacrylates, cellulose esters, and the like. Generally, charge generating layer dispersions for immersion coating mixtures contain pigment and film forming polymer in the weight ratio of from 20 percent pigment/80 percent polymer to 80 percent pigment/ 20 percent polymer. The pigment and polymer combination are dispersed in solvent to obtain a solids content of between about 3 and about 6 weight percent based on total weight of the mixture. However, percentages outside of these ranges may be employed so long as the objectives of the process of this invention are satisfied. A representative charge generating layer coating dispersion comprises, for example, about 2 percent by weight hydroxy gallium phthalocyanine; about 1 percent by weight of terpolymer of vinyl acetate, vinyl chloride, and maleic acid (or a terpolymer of vinylacetate, vinylalcohol and hydroxyethylacrylate); and about 97 percent by weight cyclohexanone. Coating defects can readily be identified in deposited charge generating layers because the deposited layers are colored and the underlying layer is white. The uneven deposits in the charge generating layers include beads, rings, and fingering patterns. Conventional solutions for the undercoating and the charge transport layer do not appear to be affected by the absence of ramping of the withdrawal rate. The rings that are formed on charge generating layers are actually bead rings. These rings appear to occur mainly in dispersions of the charge generating layer and possibly in undercoating layers that contain optional dispersed particles.

In other embodiments, a coating mixture may be formed by dissolving any suitable charge transport material in a solution of a film forming polymer. Typical charge transport materials include, for example, compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds. Typical film forming polymers include, for example, resins such as polycarbonate, polymethacrylates, polyarylate, polystyrene, polyester, polysulfone, styrene-acrylonitrile copolymer, styrene-methyl methacrylate copolymer, and the like. An illustrative charge transport layer coating composition contains, for example, about 10 percent by weight N,N'-diphenyl-N,N'-bis(3-methylphenyl)-[1,1'-biphenyl]-4,4'diamine; about 14 percent by weight poly(4,4'-diphenyl-1,1'-cyclohexane carbonate (400 molecular weight); about 57 percent by weight tetrahydrofuran; and about 19 percent by weight monochlorobenzene.

A coating composition may also contain any suitable solvent, preferably an organic solvent. Typical solvents include, for example, tetrahydrofuran, monochlorobenzene, cyclohexanone, n-butyl acetate, and the like and mixtures thereof.

After all the desired layers are coated onto the substrates, they may be subjected to elevated drying temperatures such as, for example, from about 100° C. to about 160° C. for about 0.2 hours to about 2 hours.

The process of this invention maintains the stability of the coating bead for coating dispersions that ultimately results in a uniform, defect-free coating. The ramping of with coating mixture withdrawal speed for a predetermined distance is a key and applies to any type of immersion coating system. Non-uniform deposits normally occur at the top of coatings formed by immersion coating. The process of this invention reduces the band of unacceptable coating material at the top of the deposited coating and eliminates the formation of fingering patterns.

PREFERRED EMBODIMENT OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A charge generating layer coating dispersion comprising 2 percent by weight hydroxy gallium phthalocyanine; 1 percent by weight of terpolymer of vinyl acetate, vinyl chloride, and maleic acid (or a terpolymer of vinylacetate, vinylalcohol and hydroxyethylacrylate) and about 97 percent by weight cyclohexanone. A coating vessel similar to the one illustrated in the FIGURE was utilized to apply the dispersion on an aluminum drum having a 1.5 micrometer thick coating of Luckamide 5003 (a substituted nylon). The drum was 50 centimeters long and had an outside diameter of 23 centimeters. This drum was mounted in a coating vessel with the axis of the drum aligned vertically. The interior of the coating vessel had a cylindrical shape cross section having an imaginary axis which was coaxially aligned with the axis of the drum. The gap space between the outer surface of the coated drum and the adjacent coating vessel wall was 12 millimeters. After the gap space was filled to below about 20 millimeters from the top of the drum with the charge generating layer coating dispersion, the coating dispersion was withdrawn by a positive displacement pump without ramping the coating speed, i.e. the target rate of withdrawal equivalent to a coating speed of 200 mm/min was attained within 2 seconds of initiating the withdrawal. This is characteristic of pumps with no ramping step in the procedure. After drying of the deposited coating at 110° C. for 30 minutes. The coated drum was visually examined with the naked eye. Coating defects were readily identified in deposited charge generating layer because the deposited layers are colored and the underlying layer was white. The clearly discernable uneven deposits in the charge generating layers included beads, rings, fingering patterns at the top of the drum which appeared to have led to uncoated spots located further down the drum from the fingering patterns.

EXAMPLE II

The process of Example I was repeated with the same materials and same apparatus, except that removal of the coating dispersion initiated at a gradually increasing rate to a target flow rate equivalent to a coating speed of 200 millimeters/min. in a predetermined distance of 10 millimeters in 15 seconds using the same positive displacement pump driven by a variable speed motor and further removal was continued at the predetermined flow rate equivalent to a target coating speed equivalent to 200 mm/min to deposit on the substrate a layer of the coating mixture having a wet thickness of between about 10 micrometers and about 40 micrometers, for example, of about 10 micrometers. After drying of the deposited coating at 110° C. for 30 minutes. The coated drum was visually examined with the naked eye. No coating defects were found. There was no evidence of nonuniformities, such as fingering or rings, at the top edge of the coating and no nonuniformities, such as areas of lighter or no coating, in the remainder of the drum.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A process for immersion coating of a substrate comprising: positioning a polymer coated substrate having a top and bottom within a coating vessel having an inner surface to define a space between the inner surface of the vessel and the outer surface of the substrate between 10 millimeters to about 3 centimeters;

filling at least a portion of the space with a coating mixture;

stopping the filling at about 1 millimeter to about 10 millimeters below the top of the substrate;

initiating removal of the coating mixture at an increasing flow rate beginning at 0 and increasing to a predetermined maximum flow rate in a predetermined distance; and continuing the removal of the coating mixture from the space at the predetermined maximum flow rate to deposit a layer of the coating mixture on the polymer coated substrate, and wherein the resulting coated layer is free of non-uniformity defects.

2. A process according to claim 1 including increasing the flow rate to a predetermined maximum in a distance of between about 2 millimeters and about 20 millimeters.

3. A process according to claim 1 wherein the coating mixture is a dispersion of charge generating particles in a solution of a film polymer.

4. A process according to claim 1 wherein the substrate is a hollow cylindrical drum.

5. A process according to claim 4 wherein the inner surface of the coating vessel has a cylindrical cross section, the inner surface being spaced from and coaxial with the drum.

6. A process according to claim 1 including initiating removal of the coating mixture at an increasing rate from 0 to a predetermined maximum flow rate and the predetermined distance is between about 10 millimeters and about 20 millimeters.

7. A process according to claim 1 wherein the initiating removal of the coating mixture is at a rate from 0 to the predetermined maximum flow rate in the predetermined distance and the removal is completed in between about 15 seconds and about 20 seconds.

8. A process according to claim 1 wherein the predetermined distance is between about 10 millimeters and about 20 centimeters.

9. A process according to claim 1 wherein the predetermined maximum flow rate is between about 50 millimeters/min. to about 500 millimeters/min.

10. A process according to claim 1 wherein the layer of the coating mixture deposited has a wet thickness of between about 10 micrometers and about 40 micrometers.

11. A process according to claim 1 wherein the non-uniformity defects include fingers, rings, or wavy flow patterns.

12. A process according to claim 1 wherein the polymer coated substrate is a drum with a nylon overcoat.

* * * * *